US005283161A

United States Patent [19]

Toya et al.

[11] Patent Number: 5,283,161

[45] Date of Patent: Feb. 1, 1994

[54] SILVER HALIDE PHOTOGRAPHIC MATERIAL AND METHOD FOR PROCESSING THE SAME

[75] Inventors: Ichizo Toya; Mikizo Kuwabara; Hiroshi Kawamoto, all of Kanagawa, Japan

[73] Assignee: Fuji Photo Film Co., Ltd., Kanagawa, Japan

[21] Appl. No.: 757,758

[22] Filed: Sep. 11, 1991

[30] Foreign Application Priority Data

Sep. 12, 1990 [JP] Japan ..... 2-242219
Oct. 18, 1990 [JP] Japan ..... 2-280457

[51] Int. Cl.[5] ..... G03C 7/00

[52] U.S. Cl. ..... 430/375; 430/434; 430/566; 430/607; 430/963

[58] Field of Search ..... 430/375, 434, 566, 607, 430/963

[56] References Cited

U.S. PATENT DOCUMENTS

| | | | |
|---|---|---|---|
| 4,510,229 | 4/1985 | Oka et al. | 430/265 |
| 4,845,020 | 7/1989 | Itoh et al. | 430/445 |
| 5,021,326 | 6/1991 | Meckl et al. | 430/567 |
| 5,028,520 | 7/1991 | Ito | 430/567 |
| 5,057,405 | 10/1991 | Shiba et al. | 430/567 |

FOREIGN PATENT DOCUMENTS

| | | |
|---|---|---|
| 0308212 | 3/1989 | European Pat. Off. . |
| 1-302248 | 6/1989 | Japan . |

*Primary Examiner*—Janet C. Baxter
*Attorney, Agent, or Firm*—Sughrue, Mion, Zinn, Macpeak & Seas

[57] ABSTRACT

A method for rapidly processing a silver halide photographic material comprising a support having thereon at least one light-sensitive silver halide emulsion layer and a silver halide photographic material therefor are disclosed. The total amount of binder on one side of the support is not more than 3.0 g/m$^2$, the photographic materials contains in at least one layer at least one compound selected from the group consisting of compounds represented by formulae (I) and (II):

$$X_1-A-X_2 \quad (I)$$

(II)

wherein $X_1$, $X_2$, A, $R_{11}$, $R_{12}$, $R_{13}$, $R_{14}$, $R_{15}$, and $R_{16}$ are defined in the specification. Processing may be effected in a total processing time of from 15 to 45 seconds. Pressure sensitivity can be reduced without reducing photographic speed.

12 Claims, No Drawings

SILVER HALIDE PHOTOGRAPHIC MATERIAL AND METHOD FOR PROCESSING THE SAME

FIELD OF THE INVENTION

This invention relates to a technique for reducing pressure sensitivity of silver halide photographic materials and reducing contamination of radiographic intensifying screens. More particularly, it relates to a silver halide photographic material for medical use and to a method of rapid photographic processing capable of coping with emergencies.

BACKGROUND OF THE INVENTION

In general, photographic materials containing a silver halide emulsion layer are subject to various outside pressures. For example, negative films for general photography are apt to be bent when rolled in a cartridge or loaded into a camera, or pulled or scratched with a carriage part of a camera on film feeding. Sheet films such as printing films and direct radiographic films for medical use are often bent when handled by hand. When handled in daylight conveying equipment or high-speed changers, photographic materials are brought into contact with metallic or rubber parts under strong pressure. Further, all kinds of photographic materials receive great pressure when trimmed or finished.

Pressure thus applied to a photographic light-sensitive material is transmitted to the silver halide grains through gelatin, a binder for the silver halide grains, or an other high-molecular weight substance which functions as a mediator. It is known that application of pressure to silver halide grains causes blackening irrespective of exposure amount or desensitization. For the details of these phenomena, reference can be made, e.g., in K. B. Mather, *J. Opt. Soc. Am.*, Vol. 38, p. 1054 (1948), P. Faelens and P. de Smet, *Sci. et Ind. Photo.*, Vol. 25, No. 5, p. 178 (1954), and P. Faelens, *J. Photo. Sci.*, Vol. 2, p. 105 (1954).

There has therefore been a demand for a photographic light-sensitive material whose photographic performance is unaffected by pressure. Susceptibility to pressure is difficult to control, particularly in photographic materials in which the amount of a binder is reduced so as to improve suitability for rapid processing.

In general, there is an unfavorable correlation between photosensitivity and pressure sensitivity. That is, as photosensitivity increases, pressure sensitivity also increases.

Moreover, a sensitizing dye promotes the tendency of silver halide grains to cause fog when subjected to pressure. If a large quantity of a sensitizing dye is used for color sensitization in an attempt to increase light absorption and thereby to increase sensitivity, it follows that blackening due to pressure application becomes remarkable. As a means to avoid this disadvantage, it is known to incorporate a plasticizer for polymers or emulsions or to reduce the silver halide/gelatin ratio to thereby prevent applied pressure from reaching the silver halide grains.

Known plasticizers include heterocyclic compounds as disclosed in British Patent 738,618, alkyl phthalates as disclosed in British Patent 738,637, alkyl esters as described in British Patent 738,639, polyhydric alcohols as disclosed in U.S. Pat. No. 2,960,404, carboxyalkyl cellulose as disclosed in U.S. Pat. No. 3,121,060, paraffin and carboxylic acid salts as disclosed in JP-A-49-5017 (the term "JP-A" as used herein means an "unexamined published Japanese patent application"), and alkyl acrylates and organic acids as disclosed in JP-B-53-28086 (the term "JP-B" as used herein means an "examined published Japanese patent application").

Since addition of a plasticizer causes a reduction in the mechanical strength of an emulsion layer, there is a limit to allowable amount of a plasticizer that may be added. Further, an increase in the gelatin amount results in retardation of development, which is unfavorable for a photographic material which is to be subjected to rapid processing. Accordingly, sufficient improvement in pressure characteristics can hardly be obtained by either of the above-described means.

On the other hand, tabular grains provide high optical density with a reduced silver amount because of their high covering power per unit area as described in U.S. Pat. Nos. 4,434,226, 4,439,520, and 4,425,425. In addition, they have a large surface area per unit volume and are accordingly capable of adsorbing a larger quantity of a sensitizing dye in spectral sensitization, thus exhibiting a higher light capturing ability. These advantages of tabular grains can be best used with a sensitizing dye in an amount of 60% or more, preferably 80% or more, and more preferably 100% or more, of the saturation adsorption. As previously stated, however, pressure sensitivity increases with the amount of the sensitizer present. Additionally, the shape of the tabular grains makes them likely to deform on the application of an outer force. For these reasons, use of tabular grains does not achieve particularly satisfactory improvement in pressure characteristics.

SUMMARY OF THE INVENTION

An object of the present invention is to provide a method for rapidly processing silver halide photographic materials during emergencies by which the problem of pressure sensitivity is solved and by which there is no contamination of intensifying screens.

Another object of the present invention is to provide a silver halide photographic material which is suitable for the above-described rapid processing and is free from sensitivity changes during the dissolution time in the preparation of a silver halide emulsion.

It has now been found that the above objects of the present invention are accomplished by a method for processing a silver halide photographic material comprising a support having thereon at least one light-sensitive silver halide emulsion layer, in which the total amount of binder in the layers on one side of the support inclusive of the silver halide emulsion layer, the surface protective layer and other layers is not more than 3.0 g/m$^2$, and in which the photographic material contains in at least one layer at least one compound selected from the group consisting of the compounds represented by formula (I):

$$X_1-A-X_2 \qquad \text{(I)}$$

wherein $X_1$ and $X_2$ each represents

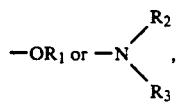

wherein $R_1$ represents a hydrogen atom or a group capable of being converted to a hydrogen atom on hydrolysis, and $R_2$ and $R_3$ each represents a hydrogen atom, an alkyl group, an aryl group, a heterocyclic group, an alkylsulfonyl group, an arylsulfonyl group, a heterocyclic sulfonyl group, an alkylcarbonyl group, an arylcarbonyl group, a heterocyclic carbonyl group, a sulfamoyl group, or a carbamoyl group; and A represents an arylene group; provided that at least one of $X_1$, $X_2$, and A is substituted with a group which accelerates adsorption onto silver halide grains, and the compounds represented by formula (II):

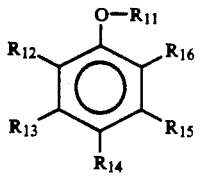

(II)

wherein $R_{11}$ represents a hydrogen atom or a protecting group which is removable under alkaline conditions; and $R_{12}$, $R_{13}$, $R_{14}$, $R_{15}$, and $R_{16}$, which may be the same or different, each represents a hydrogen atom or a substituent, provided that the total number of carbon atoms contained in $R_{12}$, $R_{13}$, $R_{14}$, $R_{15}$, and $R_{16}$ is at least 6, and at least one of $R_{12}$ and $R_{14}$ represents a hydroxyl group, a sulfonamido group, or a carbonamido group; $R_{12}$, $R_{13}$, $R_{14}$, $R_{15}$, $R_{16}$, and $OR_{11}$ may together form a ring. The processing is effected by using an automatic rapid developing machine for a total processing time (dry-to-dry) of from 15 to 45 seconds.

DETAILED DESCRIPTION OF THE INVENTION

In formula (I), A is a substituted or unsubstituted arylene group, e.g., phenylene and naphthylene. Suitable substituents to A include a halogen atom (e.g., F, Cl, Br), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably an alkanoylamino group having from 1 to 20 carbon atoms or a benzoylamino group having from 6 to 20 carbon atoms), a nitro group, a cyano group, an oxycarbonyl group (preferably an alkoxycarbonyl group having from 1 to 20 carbon atoms or an aryloxycarbonyl group having from 6 to 20 carbon atoms), a carboxyl group, a sulfo group, a hydroxyl group, a ureido group (preferably an alkylureido group having from 1 to 20 carbon atoms or an arylureido group having from 6 to 20 carbon atoms), a sulfonamido group (preferably an alkylsulfonamido group having from 1 to 20 carbon atoms or an arylsulfonamido group having from 6 to 20 carbon atoms), a sulfamoyl group (preferably an alkylsulfamoyl group having from 1 to 20 carbon atoms or an arylsulfamoyl group having from 6 to 20 carbon atoms), a carbamoyl group (preferably an alkylcarbamoyl group having from 1 to 20 carbon atoms or an arylcarbamoyl group having from 6 to 20 carbon atoms), an acyloxy group (preferably having from 1 to 20 carbon atoms), a substituted or unsubstituted amino group (preferably a secondary or tertiary amino group substituted with an alkyl group having from 1 to 20 carbon atoms or an aryl group having from 6 to 20 carbon atoms), a carbonic ester group (preferably an alkyl carbonate group having from 1 to 20 carbon atoms or an aryl carbonate group having from 6 to 20 carbon atoms), a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), and a heterocyclic group (e.g., pyridine, imidazole, furan). Two or more substituents, if any, may be the same or different. Where two substituents are on carbon atoms adjacent to each other on a benzene ring, they may be connected together to form a 5- to 7-membered carbonaceous ring or heterocyclic ring, either saturated or unsaturated. Such a cyclic structure includes a cyclopentane ring, a cyclohexane ring, a cycloheptane ring, a cyclopentene ring, a cyclohexadiene ring, a cycloheptadiene ring, an indane ring, a norbornane ring, a norbornene ring, a benzene ring, and a pyridine ring. These rings may further be substituted.

The total carbon atom number of substituents to A is preferably up to 20, and more preferably up to 10.

The group capable of being converted to a hydrogen atom on hydrolysis as represented by $R_1$ includes $—COR_4$, wherein $R_4$ represents a substituted or unsubstituted alkyl group, a substituted or unsubstituted aryl group, or a substituted or unsubstituted amino group; and

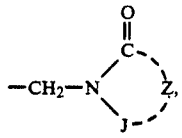

wherein J represents

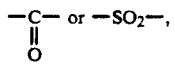

and Z represents an atomic group necessary to form at least one 5- or 6-membered heterocyclic ring.

The $R_2$ and $R_3$ groups, which may be the same or different, each represents a hydrogen atom, a substituted or unsubstituted alkyl group, a substituted or unsubstituted aryl group, a substituted or unsubstituted heterocyclic ring, a substituted or unsubstituted alkylsulfonyl group, a substituted or unsubstituted arylsulfonyl group, a substituted or unsubstituted heterocyclic sulfonyl group, a substituted or unsubstituted alkylcarbonyl group, a substituted or unsubstituted arylcarbonyl group, a substituted or unsubstituted heterocyclic carbonyl group, a substituted or unsubstituted sulfamoyl group, or a substituted or unsubstituted carbamoyl group; or $R_2$ and $R_3$ may together form a nitrogen-containing heterocyclic ring (e.g., morpholino, piperidino, pyrrolidino, imidazolyl, piperazino).

Examples of suitable substituents to $R_2$ or $R_3$ include those mentioned with respect to A.

The group which accelerates adsorption onto silver halide grains (hereinafter simply referred to as the adsorption accelerating group) is represented by formula:

$Y—L)_m$ wherein Y represents an adsorption accelerating group; L represents a divalent linking group; and m represents 0 or 1.

Preferred adsorption accelerating groups which are represented by Y include a thioamido group, a mercapto group, a group containing a disulfide linkage, and a 5- or 6-membered nitrogen-containing heterocyclic group.

The thioamido adsorption accelerating group represented by Y is a divalent group of formula $$—\overset{\overset{\displaystyle S}{\|}}{C}\text{-amino-},$$

which may be a part of either a cyclic structure or an acyclic thioamido group. Suitable thioamido adsorption accelerating groups are described, e.g., in U.S. Pat. Nos. 4,030,925, 4,031,127, 4,080,207, 4,245,037, 4,255,511, 4,266,013, and 4,276,364, *Research Disclosure,* Vol. 151, No. 15162 (Nov., 1976), and ibid., Vol. 176, No. 17626 (Dec., 1978).

Specific examples of the acyclic thioamido group include thioureido, thiourethane, and dithiocarbamic ester groups. Specific examples of the cyclic thioamido group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione groups, each of which may be substituted.

The mercapto adsorption accelerating group represented by Y includes an aliphatic mercapto group, an aromatic mercapto group, and a heterocyclic mercapto group. A heterocyclic mercapto group in which —SH group is bonded to a carbon atom adjacent to a nitrogen atom has the same meaning as the cyclic thioamido group which is a tautomer of the former. Specific examples of this a heterocyclic mercapto group are therefore the same as those mentioned above with respect to the latter.

The group containing a disulfide linkage represented by Y has up to 20 carbon atoms, and those having the disulfide linkage which constitutes a part of 4- to 12-membered ring are preferred. The ring which may be substituted, is bonded to the compound of formula (I) through the divalent linking group described below.

The 5- or 6-membered nitrogen-containing heterocyclic group represented by Y includes those groups comprising nitrogen, oxygen, sulfur, and carbon atoms. Preferred among them are benzotriazole, triazole, tetrazole, indazole, benzimidazole, imidazole, benzothiazole, thiazole, benzoxazole, oxazole, thiadiazole, oxadiazole, and triazine rings, each of which may have an appropriate substituent(s) selected from, for example, those groups listed above with respect to the substituents for A.

Y preferably represents a cyclic thioamido group (i.e., mercapto-substituted nitrogen-containing heterocyclic group, e.g., 2-mercaptothiadiazole, 3-mercapto-1,2,4-triazole, 5-mercaptotetrazole, 2-mercapto-1,3,4-oxadiazole, 2-mercaptobenzoxazole) or a nitrogen-containing heterocyclic group (e.g., benzotriazole, benzimidazole, indazole).

In the compounds of formula (I), there may be two or more adsorption accelerating groups $Y—L)_m$, which may be the same or different.

The divalent linking group L is an atom or atomic group containing at least one C, N, S, or O atom. Specific examples of this divalent group include an alkylene group, an alkenylene group, an alkynylene group, an arylene group, —O—, —S—, —NH—, —N=, —CO—, and $—SO_2—$ (each of which may have a substituent), either alone or in combination thereof. Specific examples of the divalent group are shown below:

—CONH—, —NHCONH—, $—SO_2NH—$,

—COO—, —NHCOO—,

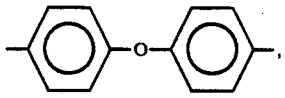

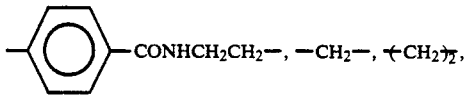

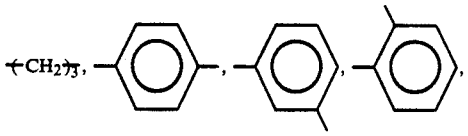

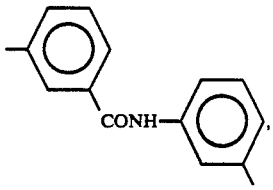

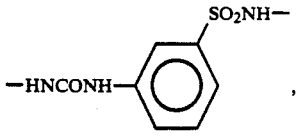

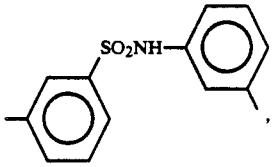

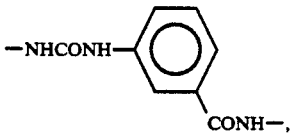

$—NHCONHCH_2CH_2CONH—$,

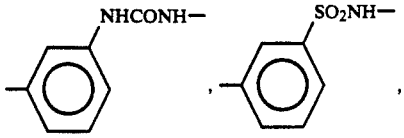

-continued

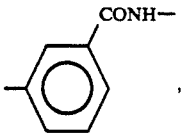

, $-CH_2CH_2SO_2NH-$, $-CH_2CH_2CONH-$

The above-illustrated divalent groups may further have an appropriate substituent(s) selected from those mentioned above with respect to the substituents to A.

In the case where Y represents a ring having a disulfide linkage constituting a part of the ring, the divalent linking group L preferably has 1 to 18 carbon atom and examples thereof include a straight chain, branched or cyclic alkylene group, a substituted or unsubstituted phenylene group, —O—, —CONR—, $-SO_2NR-$, —COOR—, —S—, —NR—, —CO—, —SO—, $-SO_2-$, —OCOO—, —NRCONR'— and —NRCOO— (wherein R and R' each represents a hydrogen atom, a substituted or unsubstituted alkyl group having up to 17 carbon atoms, or a substituted phenylene or phenyl group having up to 17 carbon atoms), either alone or in combination thereof.

Of the compounds represented by formula (I), preferred are those represented by formula (III):

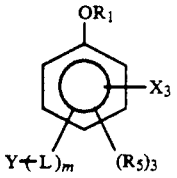

(III)

wherein $R_1$, Y, L, and m are as defined above; $X_3$ has the same meaning as $X_1$ or $X_2$; and the $R_5$ groups, which may be the same or different, each represent a hydrogen atom or a substituent.

The substituent $R_5$ is selected form those enumerated above with respect to the substituents to A.

$X_3$ is preferably at the o- or p-position of the ring with respect to $-OR_1$. Further, the group represented by $X_1$, $X_2$, or $X_3$ is preferably $-OR_1$, wherein $R_1$ is preferably a hydrogen atom.

Where $X_3$ is

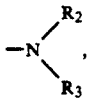

$R_2$ and $R_3$ each preferably represents a hydrogen atom, an alkyl group, an aryl group, an alkylsulfonyl group, an arylsulfonyl group, an alkylcarbonyl group, an arylcarbonyl group, or a carbamoyl group.

Specific examples of the compounds of formula (I) are shown below for illustrative purposes, but not to limit the scope of the invention:

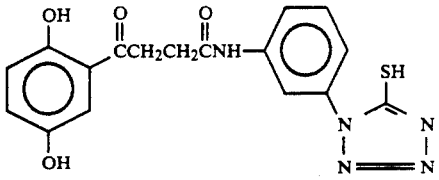

I-1)

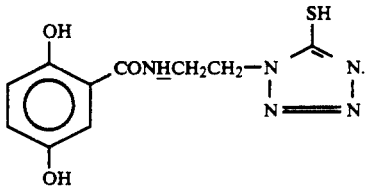

I-2)

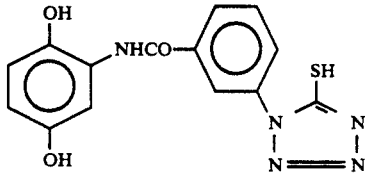

I-3)

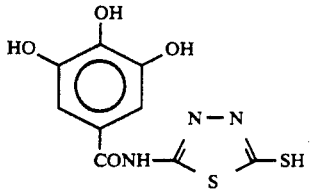

I-4)

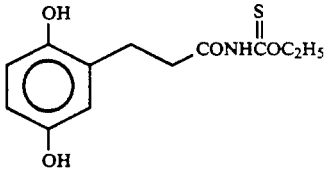

I-5

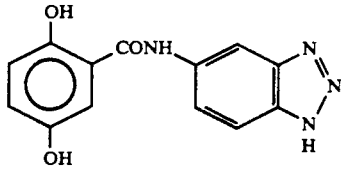

I-6)

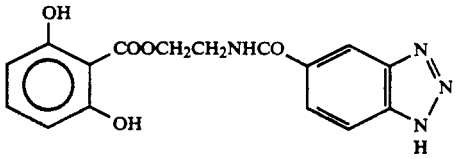

I-7)

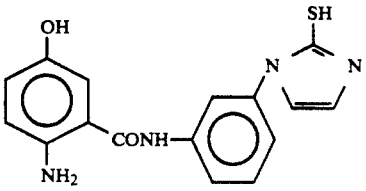

I-8)

-continued
I-9
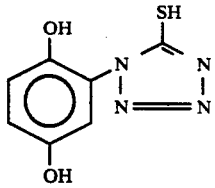
I-10)
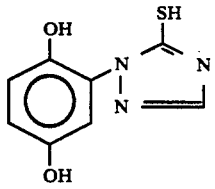
I-11)
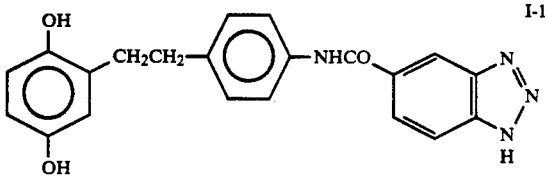
I-12)
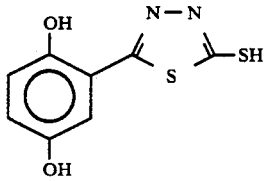
I-13)
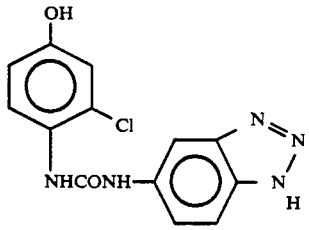
I-14)
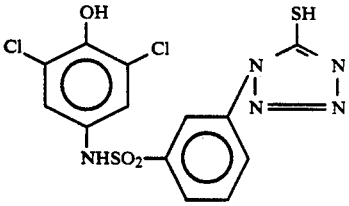
I-15
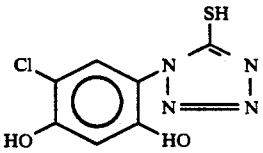
I-16)
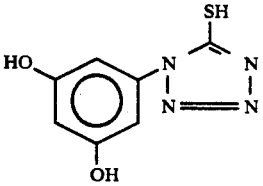
-continued
I-17)
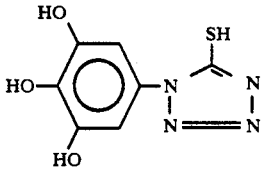
I-18)
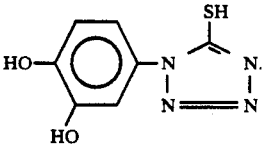
I-19)
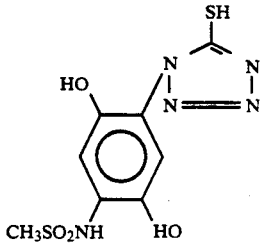
I-20)
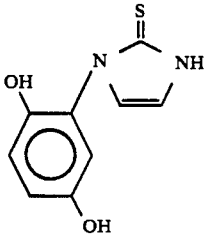
I-21)
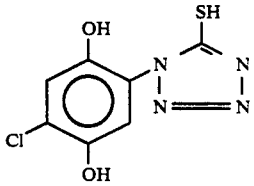
I-22
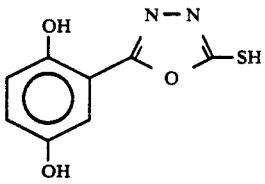
I-23)
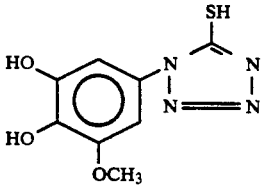
I-24)
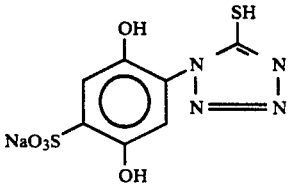

-continued

I-25)

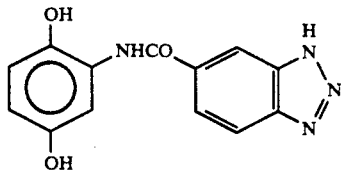

I-26)

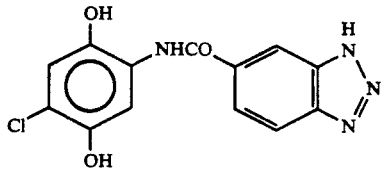

I-27)

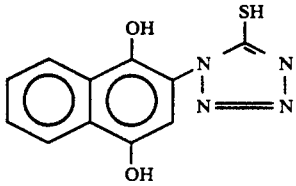

I-28)

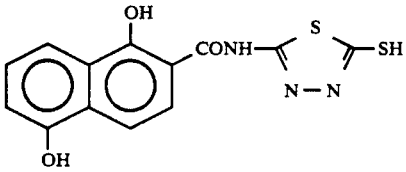

I-29)

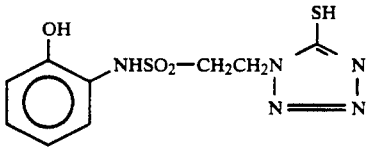

I-30)

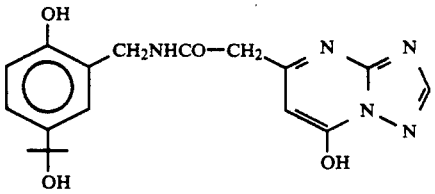

I-31)

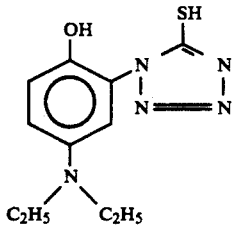

I-32)

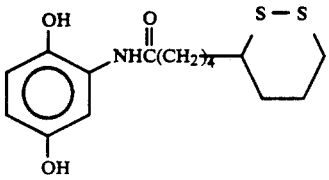

-continued

I-33)

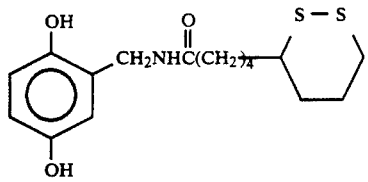

I-34)

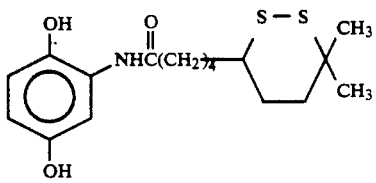

I-35)

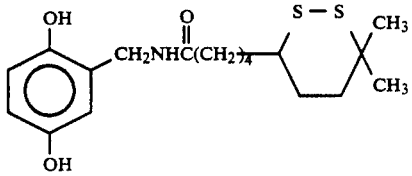

I-36)

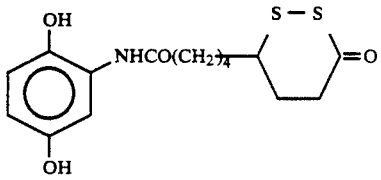

I-37)

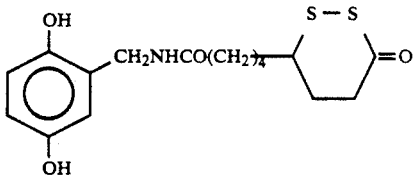

The compounds represented by formula (I) can be synthesized according to the methods described in U.S. Pat. No. 3,266,897, JP-A-59-71047, JP-A-61-90153, *J. Org. Chem.*, 34, 157 (1963) and *J. Am. Chem. Soc.*, 77, 6632(1955). A synthesis example of the compounds of by formula (I) is illustrated below.

SYNTHESIS EXAMPLE

Synthesis of Compound I-11

A mixture of 23.8 g (0.1 mol) of 5-phenylbenzotriazole carbonate, 25.2 g (0.11 mol) of 2-(4-aminophenyl)-ethylhydroquinone, and 100 ml of dimethylacetamide were heated at 120° C. (outer temperature) on an oil bath in a nitrogen stream for 5 hours under stirring. The reaction mixture was freed of dimethylacetamide by distillation under reduced pressure, and to the residue was added 200 ml of methanol. A trace amount of a by-product black crystal remained undissolved. This insoluble matter was removed by filtration by suction, and the filtrate was freed of the solvent by distillation under reduced pressure. The residue was purified by silica gel column chromatography (chloroform/methanol=4/1 by volume) and then washed with methanol to give 14.4 g (38.5%) of Compound I-11 having a melting point of 256°-257° C.

In formula (II), the substituent represented by $R_{12}$, $R_{13}$, $R_{14}$, $R_{15}$, or $R_{16}$ preferably includes a halogen atom, a hydroxyl group, a sulfo group, a carboxyl group, a cyano group, a straight chain, branched, or cyclic alkyl group having not more than 30 carbon atoms, an alkenyl group, an alkynyl group, an aralkyl group, an aryl group, an alkoxy group, an aryloxy group, an alkylthio group, an arylthio group, a carbonamido group, a sulfonamido group, a ureido group, an alkoxycarbonylamino group, an aryloxycarbonylamino group, an acyloxy group, a sulfamoylamino group, a sulfonyloxy group, a carbamoyl group, a sulfamoyl group, an acyl group, a sulfonyl group, an alkoxycarbonyl group, an aryloxycarbonyl group, or a 3- to 12-membered heterocyclic group containing at least one hetero atom selected from oxygen, nitrogen, sulfur, phosphorus, selenium, and tellurium. These groups may have a substituent(s) selected from those enumerated for $R_{12}$ to $R_{17}$.

The protecting group represented by $R_{11}$ includes an acyl group, an alkoxycarbonyl group, an aryloxycarbonyl group, a carbamoyl group each having not more than 25 carbon atoms, and those described in JP-A-59-197037, JP-A-59-201057, JP-A-59-108776, and U.S. Pat. No. 4,473,537.

Where any two of $R_{12}$, $R_{13}$, $R_{14}$, $R_{15}$, $R_{16}$, and $OR_{11}$ are taken together to form a ring, such a ring preferably includes a saturated or unsaturated 4- to 8-membered carbonaceous or heterocyclic ring formed between $R_{12}$ and $OR_{11}$, between $R_{12}$ and $R_{13}$, between $R_{13}$ and $R_{14}$, between $R_{14}$ and $R_{15}$, between $R_{15}$ and $R_{16}$, or between $R_{16}$ and $OR_{11}$.

Two or more of the compounds of formula (II) may bond each other at any unsubstituted position of the benzene ring to form a polymer such as a dimer, a trimer, and an oligomer.

The total number of carbon atoms contained in $R_{12}$, $R_{13}$, $R_{14}$, $R_{15}$, and $R_{16}$ is at least 6, and preferably 8 or more.

Preferred examples of the compounds of formula (II) are those described below:

(1) Compounds wherein $R_{11}$ is a hydrogen atom, and $R_{14}$ is a hydroxyl group or a sulfonamido group, and more preferably a hydroxyl group.

(2) Compounds wherein $R_{11}$ is a hydrogen atom, and $R_{12}$ is a hydroxyl group or a sulfonamido group.

(3) Compounds wherein $R_{11}$ is a hydrogen atom, $R_{12}$ and $R_{16}$ are a hydroxyl group or a sulfonamido group, and $R_{14}$ is a carbamoyl group, an oxycarbonyl group, an acyl group, or a sulfonyl group, and more preferably a carbamoyl group or an oxycarbonyl group.

(4) Dimers or polymers (number of repeating units: 20 to 50).

Specific examples of the compounds of formula (II) are shown below for illustrative purposes only but not to limit the scope of the invention:

II-1)

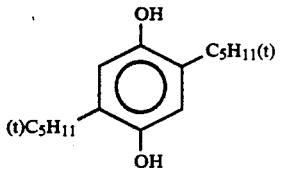

-continued

II-2)

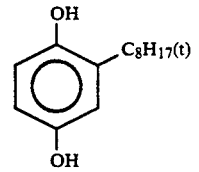

II-3)

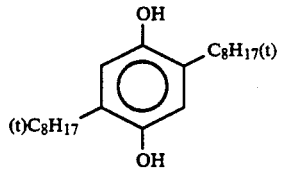

II-4)

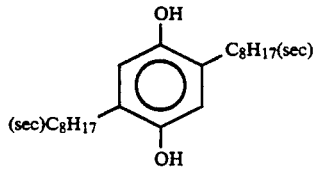

II-5)

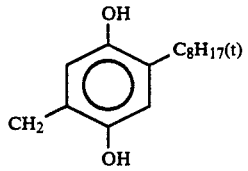

II-6)

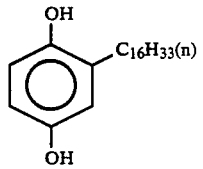

II-7)

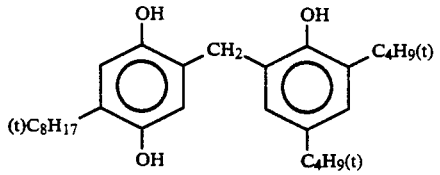

II-8)

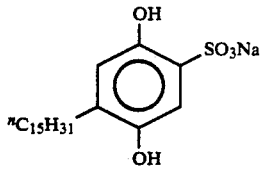

II-9)

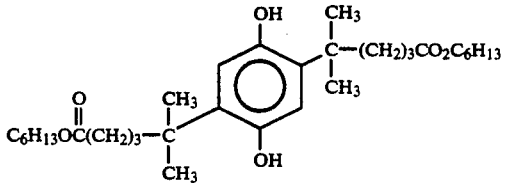

II-10)

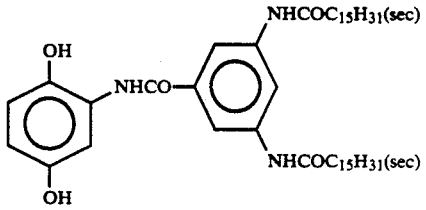

-continued

II-11)

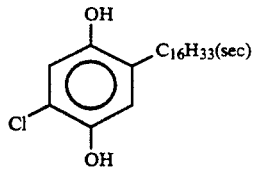

II-12)

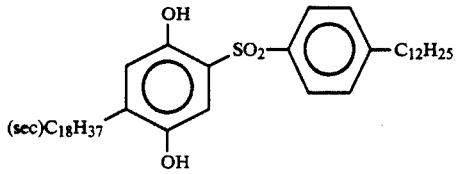

II-13)

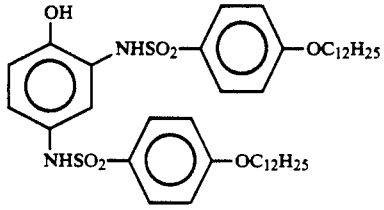

II-14)

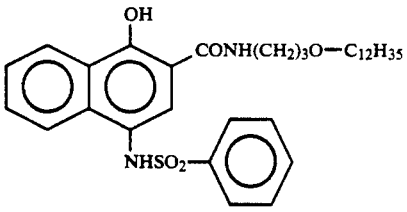

II-15)

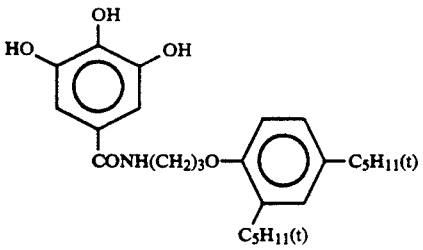

II-16)

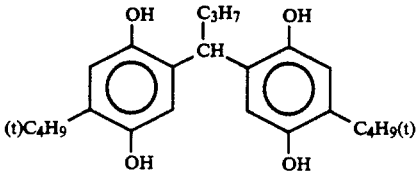

-continued

II-17)

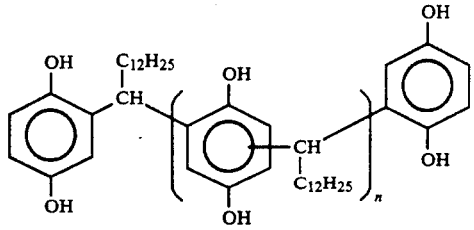

(n = 30 in average)

II-18)

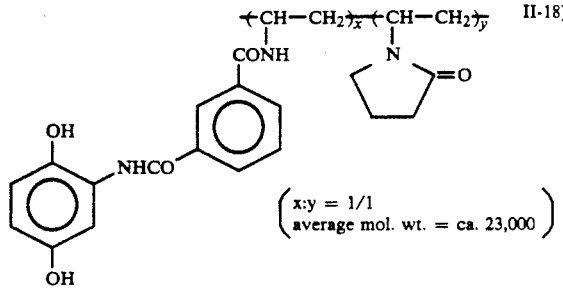

The compounds represented by formula (II) can be synthesized in accordance with the known processes disclosed in U.S. Pat. Nos. 2,701,197, 3,700,453, 3,960,570, 4,232,114, 4,277,553, 4,443,537, 4,447,523, 4,476,219, 4,717,651, and 4,732,845, JP-B-51-12250, JP-A-54-29637, JP-A-58-21249, JP-A-59-108776, JP-A-61-48856, JP-A-61-169844, and JP-A-63-309949 and patents cited therein, or analogues thereof.

The compound of formula (I) or (II) is preferably added to a light-sensitive emulsion layer. The amount of the compound of formula (I) or (II) to be added ranges from $1\times10^{-5}$ to $1\times10^{-1}$ mol and preferably from $1\times10-4$ to $5\times10^{-2}$ mol, or from $1\times10^{-4}$ to 1 mol and preferably from $1\times10^{-3}$ to $1\times10^{-1}$ mol, respectively, per mol of silver halide.

Light-sensitive materials particularly suited to the rapid processing method of the present invention can be obtained by adding the compound of formula (I) or (II) to a light-sensitive emulsion before completion of chemical sensitization, preferably at or before the commencement of chemical sensitization or during chemical sensitization, and more preferably at the commencement of chemical sensitization.

In the present invention, sensitizing dyes can also be added to a light-sensitive emulsion. Examples of useful sensitizing dyes include cyanine dyes, merocyanine dyes, complex cyanine dyes, complex merocyanine dyes, holopolar cyanine dyes, styryl dyes, hemicyanine dyes, oxonol dyes, and hemioxonol dyes.

The sensitizing dyes are preferably added in an amount of 80% or more, and particularly 100% or more and less than 200%, of saturation adsorption onto the silver halide grains, which corresponds to 300 mg or more and less than 2000 mg, and particularly 600 mg or more and less than 1000 mg, per mol of silver halide.

Specific examples of sensitizing dyes effective in the present invention are shown below:

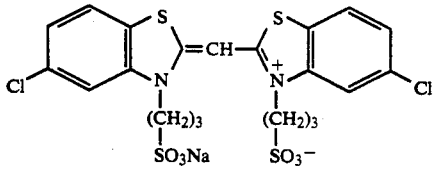
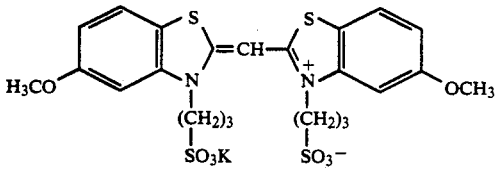
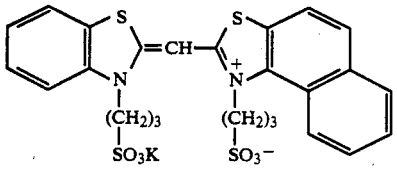
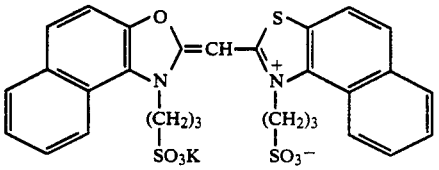
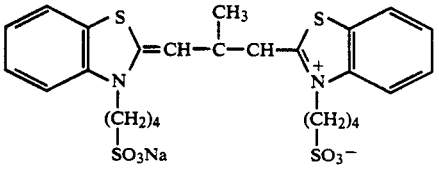
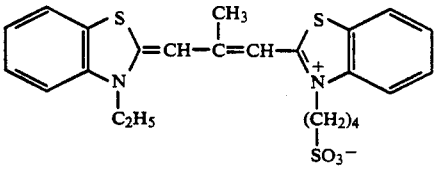
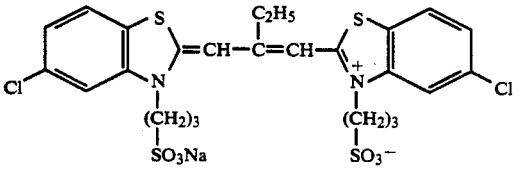
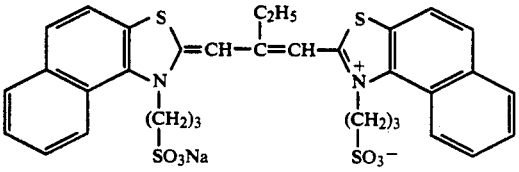

-continued

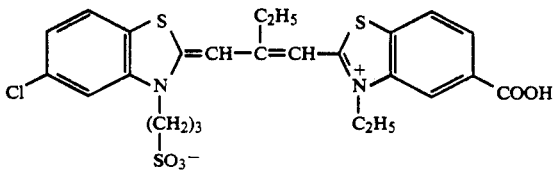

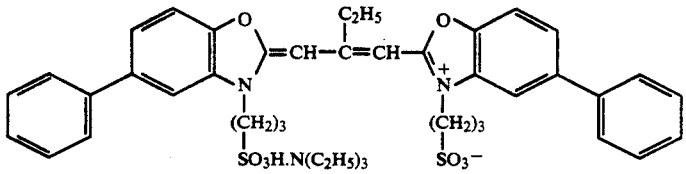

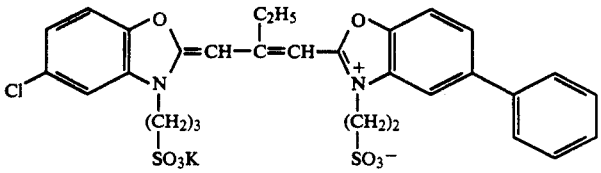

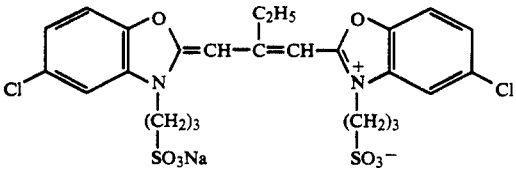

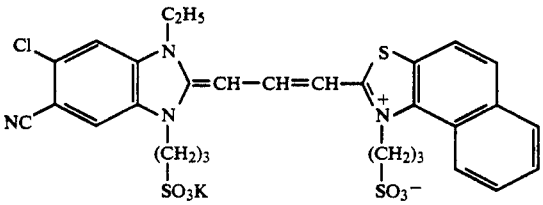

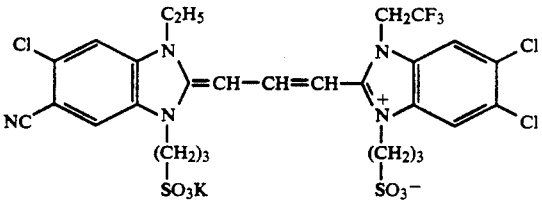

Addition of sensitizing dyes can be made together with addition of a chemical sensitizer to conduct simultaneously spectral sensitization and chemical sensitization as taught in U.S. Pat. Nos. 3,628,969 and 4,225,666, or spectral sensitization may be conducted prior to chemical sensitization as suggested in JP-A-58-113928. It is also known that sensitizing dyes may be added to an emulsion system to start spectral sensitization before completion of silver halide grain formation. It is possible as well that the sensitizing dyes be added in divided portions in such a manner that a part of the sensitizing dyes is added before chemical sensitization and the rest is added after chemical sensitization as proposed in U.S. Pat. No. 4,225,666. That is, addition of sensitizing dyes may be effected at any stage of silver halide grain formation according to various methods such as the method disclosed in U.S. Pat. No. 4,183,756. As a matter of course, all the requisite sensitizing dyes may be added to an emulsion at the time of addition to the other additive chemicals. Among these modes of addition, the method described in JP-A-63-305343, in which spectral sensitization is performed before chemical sensitization, is particularly preferred in the present invention.

Tabular silver halide grains which can be used in the light-sensitive emulsion layer include silver chloride, silver chlorobromide, silver bromide, silver iodobromide, and silver chloroiodobromide. From the viewpoint of high sensitivity, silver bromide or silver iodobromide grains, and particularly those having an iodide content of from 0 mol % up to 3.5 mol % are preferred.

Tabular silver halide grains to be used in the present invention preferably have a projected area diameter of from 0.3 to 2.0 μm, and more preferably of from 0.5 to 1.2 μm, and a distance between two parallel planes (i.e., grain thickness) of from 0.05 to 0.3 μm, and more preferably from 0.1 to 0.25 μm. The aspect ratio (i.e., diameter to thickness ratio) is preferably 3 or more and less than 20, and more preferably 5 or more and less than 8.

The silver halide emulsion layer contains tabular grains having an aspect ratio of 3 or more in a proportion of at least 50%, preferably at least 70%, and more preferably at least 90%, based on the total projected area.

The tabular silver halide grains can be prepared by an appropriate combination of conventional techniques well-known in the art. Tabular silver halide emulsions are described, e.g., Cugnac and Chateau, *Sci. et Ind. Photo.*, Vol. 33, No. 2, pp. 121–125, "Evolution of the Morphology of Silver Bromide Crystals During Physical Ripening" (1962); G. F. Duffin, *Photographic Emulsion Chemistry*, pp. 66–72, Focal Press, New York (1966); and A. P. H. Trivelli and W. F. Smith, *Photographic Journal*, Vol. 80, p. 285 (1940). In particular, these emulsions can be prepared with ease by referring to the processes described in JP-A-58-127921, JP-A-58-113972, JP-A-58-113928, and U.S. Pat. No. 4,439,520.

Tabular grain emulsions can also be prepared by a process in which seed crystals containing at least 40% by weight of tabular grains are formed at a relatively low pBr value of 1.3 or less and then allowed to grow while simultaneously feeding a silver salt solution and a halide solution under the same pBr condition. It is desirable to feed the silver salt and halide solutions during grain growth while taking care not to form new crystal nuclei.

The size of tabular the silver halide grains can be adjusted by controlling the temperature, the kind and amount of the solvent used, and the feed rates of the silver salt and halide solutions during grain growth.

Of the tabular silver halide grains, mono-dispersed hexagonal tabular grains are particularly useful. Details of the structure of mono-dispersed hexagonal tabular grains and of the processes for preparing them are described in JP-A-63-151618. In brief, a mono-dispersed hexagonal tabular grain emulsion comprises a dispersing medium having dispersed therein silver halide grains, at least 70% of which based on the total projected area comprise hexagonal grains having a longest side length to shortest side length ratio of not more than 2 and having two parallel planes as outer surfaces, with such mono-dispersion characteristics as a coefficient of variation of grain size distribution (a quotient obtained by dividing a standard deviation of grain size expressed in projected area circle-equivalent diameter by a mean grain size) of not more than 20%. The individual hexagonal tabular grains may have a homogeneous crystal structure but preferably have a heterogeneous structure comprising a core and an outer shell differing in their halogen composition. The grains may have a layered structure. The grains preferably contain therein reduction sensitization silver specks.

Silver halide grains of the so-called halogen-converted type (conversion type) as described in British Patent 635,841 and U.S. Pat. No. 3,622,318 are especially advantageous in the present invention because conversion of the surface of the tabular grains results in the production of a silver halide emulsion having higher sensitivity. A recommended amount of halogen to be converted preferably ranges from 0.05 to 2 mol %, and particularly from 0.05 to 0.6 mol %, based on the silver amount.

In using silver iodobromide, a grain structure having a high iodide layer in the inside and/or the surface thereof is particularly preferred.

Halogen conversion is usually carried out by adding to an emulsion an aqueous solution of a halide which forms a silver halide whose solubility product is smaller than that of the silver halide on the grain surface before halogen conversion. For example, halogen conversion is induced by addition of an aqueous solution of potassium bromide and/or potassium iodide to silver chloride or silver chlorobromide tabular grains, or by addition of an aqueous solution of potassium iodide to silver bromide or silver iodobromide tabular grains. The halide aqueous solution to be added preferably has a small concentration of not more than 30% by weight, and more preferably, not more than 10% by weight. It is preferably added at a feed rate of not more than 1 mol % per minute per mole of silver halide before conversion. During halogen conversion, a sensitizing dye may be present. Fine grains of silver bromide, silver iodobromide or silver iodide may be added in place of a halide aqueous solution for conversion. The fine silver halide grains to be added preferably have a grain size of not more than 0.2 μm, more preferably not more than 0.1 μm, and most preferably not more than 0.05 μm. The recommended amount of halogen to be converted preferably ranges from 0.05 to 2 mol %, and particularly from 0.05 to 0.6 mol %, based on the silver halide before conversion.

The method of halogen conversion which can be used in the present invention is not confined to any one of the above-described methods, and an appropriate combination of these methods can be employed according to the intended purpose. A silver halide composition on the grain surface before halogen conversion preferably has a silver iodide content of not more than 1 mol %, and more preferably not more than 0.3 mol %.

It is particularly effective to carry out the above-described halogen conversion in the presence of a silver halide solvent. Suitable silver halide solvents include thioether compounds, thiocyanates, and tetra-substituted thiourea, with thioether compounds and thiocyanates being particularly effective. A thiocyanate is preferably used in an amount of from 0.5 to 5 g per mol of silver halide, and a thioether compound is preferably used in an amount of from 0.2 to 3 g per mol of silver halide.

In addition, a compound capable of releasing an inhibitor at the time of development as described in JP-A-61-230135 and JP-A-63-25653 may be used.

During silver halide grain formation or physical ripening of the silver halide grains, a cadmium salt, a zinc salt, a lead salt, a thallium salt, an iridium salt or a complex salt thereof, a rhodium salt or a complex salt thereof, an iron salt or a complex salt thereof, etc., may be present in the system.

During grain formation, a so-called silver halide solvent, e.g., thiocyanates, thioether compounds, thiazolidinethione, and tetra-substituted thiourea compounds, may also be present in the system. Among them, thiocyanates, tetra-substituted thiourea compounds, and thioether compounds are preferred.

Chemical sensitization of silver halide emulsions to be used in the present invention is carried out by known techniques, such as sulfur sensitization, selenium sensitization, reduction sensitization, and gold sensitization, either alone or in combination thereof.

Gold sensitization, a typical technique of noble metal sensitization, is conducted by using a gold compound, mostly a gold complex salt. Noble metal compounds other than gold compounds, such as complex salts of platinum, palladium, and iridium, may be used as well. Specific examples of suitable noble metal compounds are described in U.S. Pat. No. 2,448,060 and British Patent 618,061.

Sulfur sensitization is carried out by using sulfur compounds contained in gelatin or other various sulfur compounds, e.g., thiosulfates, thioureas, thiazoles, and rhodanines.

A combination of sulfur sensitization using a thiosulfate and gold sensitization is particularly effective to obtain the effects of the present invention.

Reduction sensitization is performed by using stannous salts, amines, formamidinesulfinic acid, silane compounds, etc.

Tabular grains of the apex development initiation type as described in JP-A-63-305343 are extremely useful in the present invention.

For the purpose of preventing fog during preparation, preservation or photographic processing of a light-sensitive material or for stabilizing photographic performance properties, various compounds may be incorporated into a photographic emulsion independently of the above-mentioned substances capable of being adsorbed on silver halide grains which are added in the chemical sensitization stage. Such compounds include azoles, such as benzothiazolium salts, nitroimidazoles, nitrobenzimidazoles, chlorobenzimidazoles, bromobenzimidazoles, nitroindazoles, benzotriazoles, and aminotriazoles; mercapto compounds, such as mercaptothiazoles, mercaptobenzothiazoles, mercaptobenzimidazoles, mercaptothiadiazoles, mercaptotetrazoles, mercaptopyrimidiens, and mercaptotriazines; thioketo compounds, such as oxazolinethione; azaindenes, such as triazaindenes, tetraazaindenes (especially 4-hydroxy-substituted (1,3,3a,7)-tetraazaindenes), and pentaazaindenes; benzenethiosulfonic acids, benzenesulfinic acids, benzenesulfonic acid amides, and many other compounds known as antifoggants or stabilizers. In particular, nitron and its derivatives described in JP-A-60-76743 and JP-A-60-87322, mercapto compounds described in JP-A-60-80839, heterocyclic compounds described in JP-A-57-164735, and silver complex salts of heterocyclic compounds (e.g., 1-phenyl-5-mercaptotetrazole silver) are preferred.

The photographic emulsion layers or other hydrophilic colloidal layers of the light-sensitive material according to the present invention may contain various surface active agents as coating aids, antistatic agents, slip agents, emulsion or dispersion aids, anti-block agents, or for improvement of photographic characteristics (for example, development acceleration, increase of contrast or increase of sensitivity).

Included among the suitable surface active agents are nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene oxide adducts of silicone), and alkyl esters of saccharides; anionic surface active agents, such as alkylsulfonates, alkylbenzenesulfonates, alkylnaphthalenesulfonates, alkylsulfates, N-acyl-N-alkyltaurines, sulfosuccinic esters, and sulfoalkyl polyoxyethylene alkylphenyl ethers; amphoteric surface active agents, such as alkylbetaines and alkylsulfobetains; and cationic surface active agents, such as aliphatic or aromatic quaternary ammonium salts pyridinium salts, and imidazolium salts. Preferred among them are anionic surface active agents, e.g., saponin, sodium dodecylbenzenesulfonate, sodium di-2-ethylhexyl-α-sulfosuccinate, sodium p-octylphenoxyethoxyethoxyethanesulfonate, sodium dodecylsulfate, sodium triisopropylnaphthalenesulfonate, and sodium N-methyl-oleoyltaurine; cationic surface active agents, e.g., dodecyltrimethylammonium chloride, N-oleoyl-N',N',N'-trimethylammoniodiaminopropane bromide and dodecylpyridium chloride; betaines, e.g., N-dodecyl-N,N-dimethylcarboxybetaine and N-oleoyl-N,N-dimethylsulfobutylbetaine; and nonionic surface active agents, e.g., poly(average degree of polymerization n=10)oxyethylene cetyl ether, poly(n=25)oxyethylene p-nonylphenyl ether, and bis(1-poly(n=15)oxyethylene-oxy-2,4-di-t-pentylphenyl)ethane.

For use as an antistatic agent, preferred are fluorine-containing surface active agents, e.g., potassium perfluorooctanesulfonate, sodium N-propyl-N-perfluorooctanesulfonylglycine, sodium N-propyl-N-perfluorooctanesulfonylaminoethyloxy poly(n=3)oxyethylenebutanesulfonate, N-perfluorooctanesulfonyl-N',N',N'-trimethylammoniodiaminopropane chloride, and N-perfluorodecanoylaminopropyl-N',N'-dimethyl-N'-carboxybetaine; nonionic compounds as described in JP-A-60-80848, JP-A-61-112144, and JP-A-62-172343 and JP-A-62-173459; alkali metal nitrates; and conductive tin oxide, zinc oxide or vanadium pentoxide, or antimony-doped complex oxides thereof.

Matting agents which can be used in this invention include fine particles of organic compounds, e.g., polymethyl methacrylate, a methyl methacrylate-methacrylic acid copolymer, and starch, or inorganic compounds, e.g., silica, titanium dioxide, and barium strontium sulfate, as described in U.S. Pat. Nos. 2,992,101, 2,701,245, 4,142,894, and 4,396,706, each having a particle size of from 1.0 to 10 μm, and preferably from 2 to 5 μm.

The surface layer of the light-sensitive material may contain slip agents, e.g., silicone compounds as described in U.S. Pat. Nos. 3,489,576 and 4,047,958, colloidal silica as described in JP-B-56-23139, paraffin waxes, higher fatty acid esters, and starch derivatives.

Hydrophilic colloidal layers of the light-sensitive material may contain polyols, e.g., trimethylolpropane, pentanediol, butanediol, ethylene glycol, and glycerin, as a plasticizer.

Binders or protective colloids which can be used in emulsion layers, intermediate layers or surface protecting layers of the photographic materials include gelatin and other hydrophilic colloids, with gelatin being most advantageous. Examples of useful hydrophilic colloids other than gelatin include proteins, e.g., gelatin derivatives, graft polymers of gelatin with other high polymers, albumin, and casein; cellulose derivatives, e.g., hydroxyethyl cellulose, carboxymethyl cellulose, and cellulose sulfate; sugar derivatives, e.g., sodium alginate, dextran, and starch derivatives; and a wide variety of synthetic hydrophilic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole, and copolymers comprising monomers constituting these homopolymers.

Gelatin species which can be used include lime-processed gelatin, acid-processed gelatin, and enzyme-processed gelatin. Hydrolysis products or enzymatic decomposition products of gelatin are useful as well.

It is preferable to use gelatin in combination with dextran or a polyacrylamide having an average molecular weight of 50,000 or less. The methods described in JP-A-63-68837 and JP-A-63-149641 effective in the present invention.

The photographic emulsion layers or light-insensitive hydrophilic colloidal layers can contain organic or inorganic hardening agents. Examples of suitable hardening agents include chromates (e.g., chromium alum), aldehydes (e.g., formaldehyde and glutaraldehyde), N-methylol compounds (e.g., dimethylolurea), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-methylenebis[β-(vinylsulfonyl)propionamide]), active halogen compounds (e.g., 2,4-dichloro-6-hydroxy-5-triazine), mucohalogenic acids (e.g., mucochloric acid), isoxazoles, dialdehyde starch, and 2-chloro-6-hydroxytriazinylated gelatin, either individually or in combination of two or more thereof. In particular, active vinyl compounds described in JP-A-53-41221, JP-A-53-57257, JP-A-59-162546, and JP-A-60-80846 and active halogen compounds described in U.S. Pat. No. 3,325,287 are preferred. N-carbamoylpyridinium salts (e.g., 1-morpholinocarbonyl-3-pyridinio)methanesulfonate), and haloamidinium salts (e.g., 1-(1-chloro-1-pyridinomethylene)pyrrolidinium 2-naphthalenesulfonate) are also useful.

High-molecular weight hardening agents can also be effectively used in the present invention. Examples of suitable high-molecular weight hardening agents include polymers having an aldehyde group, e.g., dialdehyde starch, polyacrolein, and acrolein copolymers described in U.S. Pat. No. 3,396,029; polymers having an epoxy group as described in U.S. Pat. No. 3,623,878; polymers having a dichlorotriazine group as described in U.S. Pat. No. 3,362,827 and *Research Disclosure,* No. 17333 (1978); polymers having an active ester group as described in JP-A-56-66841; and polymers having an active vinyl group or a precursor thereof as described in JP-A-56-142524, U.S. Pat. No. 4,161,407, JP-A-54-65033, and *Research Disclosure,* No. 16725 (1978), with polymers having an active vinyl group or a precursor thereof being preferred. Those having an active vinyl group or a precursor thereof bonded to the polymer main chain thereof through a long spacer as described in JP-A-56-142524 are preferred.

Supports which can be used in the present invention preferably include a polyethylene terephthalate film and a cellulose triacetate film.

In order to improve adhesion of the support to hydrophilic colloidal layers, the surface of the support is preferably subjected to a surface treatment, such as a corona discharge, a glow discharge, and ultraviolet irradiation; or a subbing layer comprising a styrene-butadiene type latex or a vinylidene chloride type latex may be provided on the support. A gelatin layer may further be provided on the subbing layer. A subbing layer prepared from an organic solvent containing a polyethylene swelling agent and gelatin may be provided. Adhesion of the subbing layer to a hydrophilic colloidal layer may be improved by subjecting the subbing layer to a surface treatment.

As a coating aid of the subbing layer, polyethylene oxide type nonionic surface active agents are preferably used.

In order to ensure the effects of the present invention in improving pressure characteristics, a plasticizer for polymers or emulsions may be added to the emulsion layers.

The emulsion layers may also contain color forming couplers capable of developing a color upon oxidative coupling with an aromatic primary amine developing agent (e.g., phenylenediamine derivatives and aminophenol derivatives) in color development processing. Color forming couplers include magenta couplers such as 5-pyrazolone couplers, pyrazolobenzimidazole couplers, cyanoacetylcoumarone couplers, and open-chain acylacetonitrile couplers; yellow couplers, such as acylacetamide couplers (e.g., benzoylacetanilide couplers and pivaloylacetanilide couplers); and cyan couplers, such as naphthol couplers and phenol couplers. These couplers preferably contain a hydrophobic group called a ballast group in the molecule thereof and are thereby non-diffusible. The couplers may be either 4-equivalent or 2-equivalent with respect to a silver ion. Colored couplers having a color correcting effect, so-called DIR couplers capable of releasing a developing inhibitor, or colorless DIR coupling compounds which produce a colorless coupling product capable of releasing a developing inhibitor, may also be used.

There is no particular limitation on other constructions of emulsion layers to be used in the silver halide light-sensitive material of the present invention and various additives can be used if desired. For example, binders, surface active agents, dyes, ultraviolet absorbents, hardening agents, coating aids, thickening agents and so on can be used as disclosed, e.g., in *Research Disclosure,* Vol. 176, pp. 22–28 (Dec., 1978)

Any conventional processing method and processing solution, for example, those described in *Research Disclosure,* Vol. 176 (RD-17643), pp. 28–30, can be used for photographic processing of the light-sensitive material according to the present invention. The photographic processing may be either for forming a black-and-white (B/W) image (B/W photographic processing) or for forming a dye image (color photographic processing), chosen according to the intended purpose. The processing temperature is usually selected from a range of from 18° to 50° C., and preferably from 25° to 38° C.

A developing solution which can be used for B/W photographic processing contains a known developing agent, such as dihydroxybenzene developing agents (e.g., hydroquinone), 3-pyrazolidone developing agents (e.g., 1-phenyl-3-pyrazolidone), and aminohhenol developing agents (e.g., N-methyl-p-aminophenol), either alone or in combination thereof. A developing solution generally contains other known additives, such as preservatives, alkali agents, pH buffering agents, and antifoggants. If desired, dissolving aids, color toning agents, surface active agents, defoaming agents, water softeners, hardening agents (e.g., glutaraldehyde), viscosity-imparting agents and so on may also be added to a developing solution.

The fixing solution which can be used in the present invention has a commonly employed composition. Useful fixing agents include thiosulfates, thiocyanates, and organic sulfur compounds known to have a fixing action. A fixing solution may contain a water-soluble aluminum salt as a hardening agent.

The color developing solution which can be used for color photographic processing commonly comprises an alkaline aqueous solution containing a known color developing agents, usually an aromatic amine developing agent, e.g., phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline).

In addition, color developing agents described in L. F. A. Mason, *Photocraphic Processing Chemistry, pp.* 226–229, Focal Press (1966), U.S. Pat. Nos. 2,193,015 and 2,592,364, and JP-A-48-64933 may also be used.

If desired, the color developing solution may further contain other additives such as pH buffering agents, developing inhibitors, antifoggants, water softeners, preservatives, organic solvents, developing accelerators, and carboxylic acid type chelating agents. For the details of these additives, reference can be made in *Research Disclosure,* No. 17643, U.S. Pat. No. 4,083,723, and West German Patent Publication (OLS) No. 2,622,950.

Since 1967 in which Eastman Kodak Co. reported a rapid photographic processing system for the dry-to-dry time of 90 seconds, efforts has been made to further shorten the processing time, and various systems have been reported, for example, a processor SRX-501 produced by Konica Co. and a processor FPM-9000 produced by Fuji Photo Film Co., Ltd. both for the dry-to-dry time of 45 seconds, and a processor M6-RA for the dry-to-dry time of 30 seconds produced by Eastman Kodak Co. Demands for further shortening of the processing time are expected to increase so as to cope with emergencies in future too.

Under the above circumstances, the coated amount of binder in the layers of a photographic material is necessarily reduced, whereby drying of the processed material is completed for a short period of time and color remaining of the processed material are improved. In the method of the present invention, the total amount of binder in the layers on one side of the support inclusive of the silver halide emulsion layer, the surface protective layer and other layers is not more than 3.0 g/m$^2$ and preferably from 1.5 to 3.0 g/m$^2$. If the amount is more than 3.0 g/m$^2$, drying of the processed material takes a long time and color remaining is deteriorated. If it is less than 1.5 g/m$^2$, the pressure resistance of the photographic material tends to be decreased.

The present invention is now illustrated in greater detail with reference to Examples, but it should be understood that the present invention is not deemed to be limited thereto. All the percents, parts, and ratios are by weight unless otherwise specified.

EXAMPLE 1

1) Preparation of Fine AgI Grains:

To 2 l of water were added 0.5 g of potassium iodide and 26 g of gelatin, and the solution was kept at 35° C. To the gelatin solution were fed 80 cc of a silver nitrate aqueous solution containing 40 g of silver nitrate and 80 cc of an aqueous solution containing 39 g of potassium iodide over a period of 5 minutes under stirring. The rate of feeding of each solution was 8 cc/min at the beginning and thereafter linearly increased so that addition of the whole volume (80 cc) was completed in 5 minutes. After the grain formation, soluble salts were removed from the emulsion by flocculation at 35° C.

The emulsion was heated to 40° C., and 10.5 g of gelatin and 2.56 g of phenoxyethanol were added thereto, followed by pH adjustment to 6.8 with a sodium hydroxide aqueous solution. The resulting emulsion weighed 730 g and was found to comprise monodispersed fine AgI grains having a mean grain size of 0.015 μm.

2) Preparation of Tabular Grains:

To 1 l of water were added 4.5 g of potassium bromide, 20.6 g of gelatin, and 2.5 cc of a 5% aqueous solution of a thioether ($HO(CH_2)_2S(CH_2)_2S(CH_2)_2OH$), and the solution was kept at 60° C. To the solution were fed 37 cc of a silver nitrate aqueous solution containing 3.43 g of silver nitrate and 33 cc of an aqueous solution containing 2.97 g of potassium bromide and 0.363 g of potassium iodide under stirring over a period of 37 seconds in accordance with a double jet process.

After an aqueous solution containing 0.9 g of potassium bromide was added thereto, the temperature was elevated to 70° C., and 53 cc of an aqueous solution containing 4.90 g of silver nitrate was added over 13 minutes. Then, 15 cc of 25% aqueous ammonia was added thereto, and the system was allowed to physically ripen at that temperature for 20 minutes. The mixture was neutralized by addition of 14 cc of a 100% acetic acid solution. Subsequently, an aqueous solution of 133.3 g of silver nitrate and an aqueous solution of potassium bromide were fed over 35 minutes while maintaining a pAg at 8.5 in accordance with a controlled double jet process. After the addition, 10 cc of a 2N potassium thiocyanate solution and 0.05 mol %, based on the total silver amount, of the above-prepared fine AgI grains were added. The system was allowed to physically ripen at that temperature for 5 minutes, followed by cooling to 35° C. There was obtained a monodispersed emulsion containing fine tabular grains having a total iodide content of 0.31 mol %, a mean projected area diameter of 1.10 μm, a thickness of 0.165 μm, and a coefficient of variation of diameter of 18.5%.

Soluble salts were removed from the resulting emulsion by flocculation. The temperature was raised to 40° C., and 35 g of gelatin, 2.35 g of phenoxyethanol, and 0.8 g of sodium polystyrenesulfonate as a thickening agent were added thereto. The emulsion was adjusted to a pH of 5.90 and a pAg of 8.25 with a sodium hydroxide aqueous solution and a silver nitrate aqueous solution.

The emulsion was heated to 56° C. and subjected to chemical sensitization at that temperature as follows. To the emulsion was added 0.043 mg of thiourea dioxide, and the system was allowed to stand for 22 minutes to permit reduction sensitization. Then, 20 mg of 4-hydroxy-6-methyl-1,3,3a,7-tetraazaindene and 500 mg of a sensitizing dye of the formula shown below were added to the emulsion. Further, 1.1 g of a calcium chloride aqueous solution and, subsequently, 3.3 mg of sodium thiosulfate, 2.6 mg of chloroauric acid, and 90 mg of potassium thiocyanate were added thereto. Forty minutes later, the emulsion was cooled to 35° C. to obtain a tabular gain emulsion.

Sensitizing Dye:

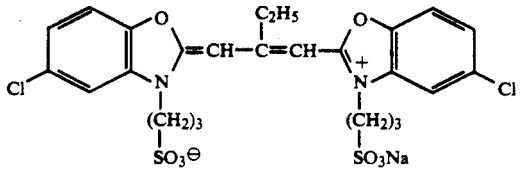

3) Preparation of Emulsion Coating Composition:

A coating composition for an emulsion layer was prepared by adding the following components to the above-prepared tabular grain emulsion in the amounts shown per mol of silver halide of the emulsion.

| | |
|---|---|
| 2,6-Bis(hydroxyamino)-4-diethylamino-1,3,5-triazine | 72 mg |
| Gelatin | 12.7 g |
| Trimethylolpropane | 9 g |
| Dextran (average molecular weight: 39,000) | 18.5 g |
| Sodium polystyrenesulfonate (average molecular weight: 600,000) | 1.8 g |
| Hardening agent (1,2-bis(vinylsulfonylacetamino)ethane) | adjusted so as to have a degree of swelling (described below) of 225% |
| 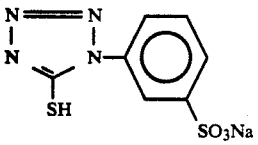 | 34 mg |
| Compound of Table 1 | see Table 1 |

4) Preparation of Surface Protective Layer Coating Composition:

A coating composition for a surface protective layer having the following formulation was prepared:

| | |
|---|---|
| Gelatin | 0.8 g/m$^2$ |
| Sodium polyacrylate (average molecular weight: 400,000) | 0.023 g/m$^2$ |
| $C_8H_{17}$—⟨⟩—$(OCH_2CH_2)_{13}SO_3Na$ | 0.013 g/m$^2$ |
| $C_{16}H_{33}O(CH_2CH_2O)_{10}H$ | 0.045 g/m$^2$ |
| $C_{16}H_{33}CON(CH_3)CH_2CH_2SO_3Na$ | 0.0065 g/m$^2$ |
| $C_8F_{17}SO_2N(C_3H_7)(CH_2CH_2O)_{15}H$ | 0.003 g/m$^2$ |
| $C_8F_{17}SO_2N(C_3H_7)(CH_2CH_2O)_4(CH_2)_4SO_3Na$ | 0.001 g/m$^2$ |
| Polymethyl methacrylate (average particle size: 3.7 μm) | 0.087 g/m$^2$ |
| Proxel (pH was adjusted to 6.4 with NaOH) | 0.0005 g/m$^2$ |

5) Preparation of Support:

(1) Preparation of Dye Dispersion D-1 for Subbing Layer:

A dye of the formula shown below was ground in a ball mill according to the method described in JP-A-63-197943.

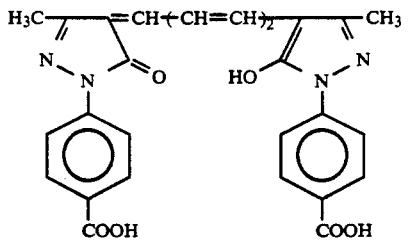

In a 2 l-volume ball mill were charged 434 ml of water and 791 ml of a 6.7% aqueous solution of a surface active agent "Triton X-200", and 20 g of the dye was added thereto. To the mixture was added 400 ml of zirconium oxide beads (diameter: 2 mm), and the mixture was ground for 4 days. Thereafter, 160 g of 12.5% gelatin was added to the mixture. After defoaming, zirconium oxide beads were removed by filtration. The resulting dye dispersion (designated D-1) was found to have a broad distribution of a particle diameter ranging from 0.05 to 1.15 μm with an average particle diameter of 0.37 μm. The dispersion D-1 was subjected to centrifugal separation to remove coarse particles of 0.9 μm or greater.

(2) Preparation of Support:

A 183 μm thick biaxially stretched polyethylene terephthalate film support containing 0.04% of a dye of the formula shown below was subjected to a corona discharge treatment.

Dye:

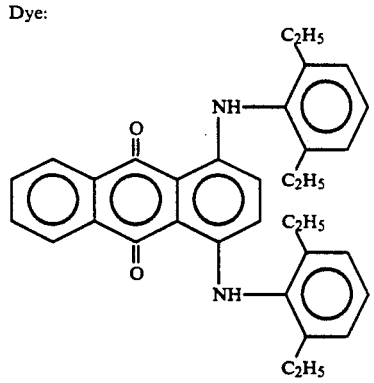

On one side of the surface-treated film was coated a first subbing layer having the following composition to a single spread of 5.1 cc/m$^2$ by means of a wire bar coater and dried at 175° C. for 1 minute. The same first subbing layer was then provided on the opposite side.

| 1st Subbing Layer Coating Composition: | |
|---|---|
| Butadiene-styrene copolymer latex solution (solid content: 40%; butadiene/styrene = 31/69) | 79 cc |
| 2,4-Dichloro-6-hydroxy-s-triazine sodium salt 4% solution | 20.5 cc |
| Distilled water | 900.5 cc |

The above latex solution contained 0.4% (on a solid basis) of an emulsifying agent: $n\text{-}C_6H_{13}OOCCH_2$ | $n\text{-}C_6H_{13}OOCCH—SO_3Na$ On each of the thus formed first subbing layers was successively coated a second subbing layer having the following composition by means of a wire bar coater and dried at 150° C.

| 2nd Subbing Layer Composition: | |
|---|---|
| Gelatin | 160 mg/m$^2$ |
| Dye dispersion D-1 | 26 mg/m$^2$ (solid basis) |
| 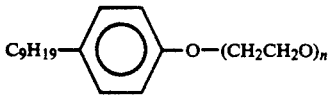 (n = 8.5) | 8 mg/m$^2$ |
| 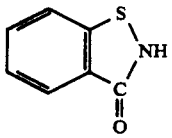 | 0.27 mg/m$^2$ |
| Matting agent (polymethyl methacrylate; average particle size: 2.5 μm) | 2.5 mg/m$^2$ |

6) Preparation of Photographic Material:

The above-prepared emulsion coating composition and surface protective layer coating composition were simultaneously coated on each side of the above-prepared transparent support by co-extrusion. The emulsion layer on each side had a dry thickness of 1.5 μm, and the silver coverage on each side was 1.7 g/m$^2$. The thus obtained photographic materials were designated Samples 1 to 11.

Samples 1 to 11 were found to have a degree of swelling of 225%.

A degree of swelling of the sample was determined as follows. After conditioning the sample at 25° C. and 60% RH (relative humidity) for 7 days, a dry thickness (a) of the hydrophilic colloid layers of the sample was measured under a scanning electron microscope. Then, the sample was immersed in distilled water at 21° C. for 3 minutes, and the swollen sample was lyophilized by liquid nitrogen. The swollen thickness (b) of the hydrophilic colloid layers of the slice of the lyophilized sample was measured under a scanning electron microscope. The degree of swelling (%) was calculated from equation:

$$\textit{Degree of Swelling}\ (\%) = [(b)-(a)]/(a) \times 100$$

6) Evaluation of Photographic Performance:

The photographic performance properties of each of Samples 1 to 11 were evaluated according to the following methods.

1) Sensitivity:

The sample was set in a cassette with both sides thereof in intimate contact with an X-ray intensifying screen "Ortho Screen HR-4" produced by Fuji Photo Film Co., Ltd. and exposed to light from both sides for 0.05 second. After exposure, the sample was processed in an automatic developing machine "SRX-1001" manufactured by KONICA Co. which was modified to increase the film conveying speed to set a dry-to-dry processing time at 30 seconds. Processing solutions having the following compositions were used.

| [Developing Solution Concentrate] | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 22.0 g |
| 5-Methylbenzotriazole | 2 g |
| Water to make | 1 l |
| (pH was adjusted to 10.60) | |
| [Fixing Solution Concentrate] | |
| Ammonium thiosulfate | 560 g |
| Sodium sulfite | 60 g |
| Disodium ethylenediaminetetraacetate dihydrate | 0.10 g |
| Sodium hydroxide | 24 g |
| Water to make | 1 l |
| (pH was adjusted to 5.10 with acetic acid) | |

At the start of developing processing, the developing tank and fixing tank o the automatic developing machine were each filled with the following processing solution.

Developing Solution: To 333 ml of the developing solution concentrate were added 667 ml of water and 10 ml of a starter containing 2 g of potassium bromide and 1.8 g of acetic acid, and the solution was adjusted to pH 10.25.

Fixing Solutions: To 250 ml of the fixing solution concentrate was added 750 ml of water.

Washing water was set to flow at a rate of 3 l/min only while the film was passing, and the water flow was stopped at other times. The rates of replenishment and processing temperatures were as follows.

| Processing Step | Temperature | Rate of Replenishment |
|---|---|---|
| Development | 35° C. | 20 ml/10 × 12 in |
| Fixing | 32° C. | 30 ml/10 × 12 in |
| Washing | 20° C. | 3 l/min |
| Drying | 55° C. | |

The reciprocal of the exposure amount which gave a density of 1.0 was determined and expressed relatively taking the result of Sample 1 as a standard (100).

2) Pressure Resistance:

Each sample was set in a cassette with both sides thereof in intimate contact with an X-ray intensifying screen "GRENEX Ortho Screen HR-4" produced by Fuji Photo Film Co., Ltd. and exposed to light for X-ray sensitometry. The exposure amount was adjusted by varying the distance between the X-ray tube and the cassette. After the exposure, the sample was bent to make an angle ob 30° and then developed by means of an automatic developing machine "FPM-9000" manufactured by Fuji Photo Film Co., Ltd. which was modified to increase a film conveying speed to set a dry-to-dry processing time at 24.2 seconds under the following processing conditions.

| | |
|---|---|
| Development: | 35° C. × 5.3 sec |
| Fixing: | 31° C. × 5.6 sec |
| Washing: | 15° C. × 3.3 sec |
| Squeegee: | 3.3 sec |
| Drying: | 50° C. × 6.7 sec |
| Dry-to-dry time: | 24.2 sec |

The developing solution and fixing solution used had the following compositions.

| [Developing Solution Composition] | |
|---|---|
| Potassium hydroxide | 29 g |
| Potassium sulfite | 44.2 g |
| Sodium hydrogencarbonate | 7.5 g |
| Boric acid | 1.0 g |
| Diethylene glycol | 12 g |
| Ethylenediaminetetraacetic acid | 1.7 g |
| 5-Methylbenzotriazole | 0.06 g |
| Hydroquinone | 25 g |
| Glacial acetic acid | 18 g |
| Triethylene glycol | 12 g |
| 5-Nitroindazole | 0.25 g |
| 1-Phenyl-3-pyrazolidone | 2.8 g |
| Glutaraldehyde (50%) | 9.86 g |
| Sodium metabisulfite | 12.6 g |
| Potassium bromide | 3.7 g |
| Water to make | 1.0 l |
| [Fixing Solution Composition] | |
| Ammonium thiosulfate (70 w/v %) | 200 ml |
| Disodium ethylenediaminetetraacetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |
| Water to make | 1.0 l |
| pH | 4.25 |

Pressure resistance was evaluated by the degree of blackening according to the following standards.

[Standard of Evaluation]

Good . . . No problem for practical use

Medium . . . Slight blackening occurred but within an acceptable degree for practical use Bad . . . Blackening occurred to an unacceptable degree for practical use 3) Screen Contamination:

The sample and an intensifying screen having a diacetyl cellulose protective layer were rubbed with each other at 30° C. and 80% RH for 24 hours. The screen was then exposed to light from a xenon lamp for 1 hour and visually observed in comparison with an intact screen. The visual change was evaluated according to the following standard.

Good . . . No change

Medium . . . Slight change but no problem for practical use

Poor . . . Appreciable change, unacceptable for practical use

The results of these evaluations are shown in Table 1 below.

TABLE 1

| Sample No. | Compound Added: Kind | Compound Added: Amount (mol/mol-Ag) | Relative Sensitivity | Pressure Resistance | Screen Contamination | Remark |
|---|---|---|---|---|---|---|
| 1 | — | — | 100 | Poor | Good | Comparison |
| 2 | Hydroquinone | $5 \times 10^{-2}$ | 100 | Good | Poor | " |
| 3 | I-2 | $1 \times 10^{-3}$ | 90 | Good | Good | Invention |
| 4 | I-8 | " | 100 | Good | Good | " |
| 5 | I-9 | " | 98 | Good | Good | " |
| 6 | I-26 | " | 100 | Good | Good | " |
| 7 | Phenylmercapto-tetrazole | " | 80 | Poor | Good | Comparison |
| 8 | II-2 | $5 \times 10^{-2}$ | 100 | Good | Good | Invention |
| 9 | II-8 | " | 100 | Good | Good | " |
| 10 | II-10 | " | 99 | Good | Good | " |
| 11 | II-16 | " | 100 | Good | Good | " |

As can be seen from Table 1, the processing method according to the present invention (i) assures improvement of pressure resistance of the light-sensitive material without causing a reduction in sensitivity, (ii) causes no contamination of the intensifying screen and (iii) is suitable for rapid processing.

EXAMPLE 2

1) Preparation of Support:

A 175 μm thick biaxially stretched and blue-tinted polyethylene terephthalate film support was subjected to a corona discharge treatment. On one side of the film was coated a first subbing layer having the same composition as the first subbing layer coating composition used in Example 1 at a single spread of 5.1 cc/m$^2$ by means of a wire bar coater and dried at 175° C. for 1 minute. The same first subbing layer was then provided on the opposite side.

Uniform solutions (a) and (b) having the following compositions were separately prepared and mixed to prepare a second subbing layer coating composition. On each of the first subbing layers was successively coated a second subbing layer coating composition to a single spread of 8.5 cc/m$^2$ by means of a wire bar coater and dried.

Solution (a):

Gelatin 8 g

Polymer latex (solid content: 15%): 31 cc

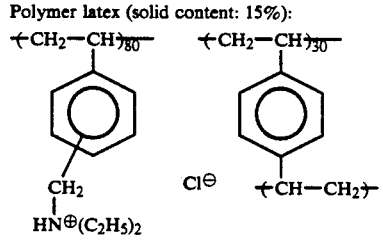

Dye (3% solution): 63 cc

-continued

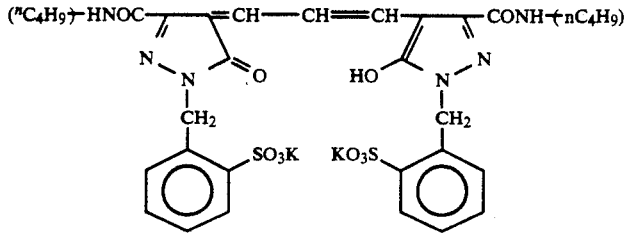

| | |
|---|---|
| $C_9H_{19}$—⟨benzene⟩—$O(CH_2CH_2O)_{8.5}H$ (1% solution) | 20 cc |
| Methyl cellulose "Metollose SM15" produced by Shin-etsu Chemical Co., Ltd. | 0.2 g |
| Water | 567 cc |
| Solution (b): | |
| Gelatin | 2 g |
| Matting agent (polymethyl methacrylate having an average particle size of 2.5 μm) | 0.3 g |
| 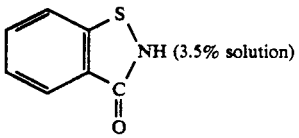 | 1 cc |
| Water | 308 cc |

2) Preparation of Emulsion Coating Composition:

To 1 l of water were added 5 g of potassium bromide, 0.05 g of potassium iodide, 35 g of gelatin, and 2.5 cc of a 5% aqueous solution of a thioether ($HO(CH_2)_2S(CH_2)_2S(CH_2)_2OH$), and the resulting gelatin aqueous solution was kept at 75° C. To the solution were fed an aqueous solution of 8.33 g of silver nitrate and an aqueous solution containing 5.94 g of potassium bromide and 0.726 g of potassium iodide while stirring over a period of 45 seconds in accordance with a double jet process. After 2.5 g of potassium bromide was added thereto, an aqueous solution containing 8.33 g of silver nitrate was further fed over 7.5 minutes at such an increasing feed rate that the final feed rate was twice the initial one.

Then, an aqueous solution of 153.34 g of silver nitrate and an aqueous solution of potassium bromide were added over 25 minutes while maintaining a pAg at 8.2 in accordance with a controlled double jet process each at such an increasing feed rate that the final feed rate was 8 times the initial one. After this addition, 15 cc of a 2N potassium thiocyanate solution was added, and then 50 cc of a 1% potassium iodide aqueous solution was added thereto over 30 seconds. The temperature was lowered to 35° C., and soluble salts were removed by flocculation. The temperature was raised to 40° C., and 58 g of gelatin, 2 g of phenol, and 7.5 g of trimethylolpropane were added to the emulsion. The emulsion was adjusted to a pH of 6.40 and a pAg of 8.45 with sodium hydroxide and potassium bromide.

The temperature was elevated to 56° C., and 735 mg of the sensitizing dye of the formula shown below was added to the emulsion.

Sensitizing Dye:

-continued

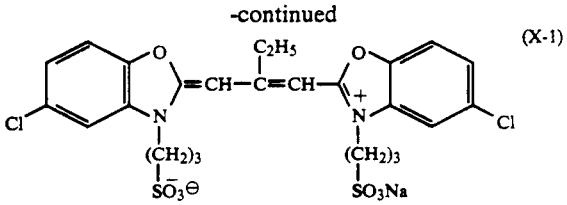

(X-1)

Ten minutes later, 8.2 mg of sodium thiosulfate pentahydrate, 163 mg of potassium thiocyanate, and 5.4 mg of chloroauric acid were added thereto and, after 5 minutes, the emulsion was quenched to solidify.

The resulting emulsion was found to comprise grains having an aspect ratio of 3 or more in a proportion of 93% based on the total projected area of total grains. All the grains having an aspect ratio of 2 or more were found to have a mean projected area diameter of 0.95 μm with a standard deviation of 18.5%, an average thickness of 0.161 μm, and an average aspect ratio of 5.9.

The following additives were added to the finished emulsion in the amounts shown, each per mol of silver halide, to prepare an emulsion coating composition.

| | |
|---|---|
| 4-Hydroxy-6-methyl-1,3,3a,7-tetraazaindene | 1.94 g |
| 2,6-Bis(hydroxyamino)-4-diethylamino-1,3,5-triazine | 80 mg |
| Sodium polyacrylate (average molecular weight: 41,000) | 4.0 g |
| Plasticizer (ethyl acrylate/acrylic acid (95/5) copolymer) | 10.0 g |
| Gelatin | for adjustment of total binder amount |
| Compound of Table 2 | see Table 2 |

3) Preparation of photographic Material:

On each side of the polyethylene terephthalate support were coated the above-prepared emulsion coating composition and a surface protective layer coating composition having the following composition by co-extrusion. The single silver coverage was 1.8 g/m$^2$.

| [Surface Protective Layer] | |
|---|---|
| Gelatin | 0.81 g/m$^2$ |
| Dextran (average molecular weight: 39,000) | 0.41 g/m$^2$ |
| Matting agent (polymethyl methacrylate/ methacrylic acid (9/1) copolymer; average particle size: 3.5 μm) | 0.06 g/m$^2$ |
| 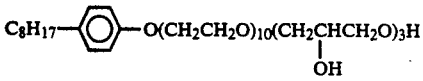 | 60 mg/m$^2$ |
| 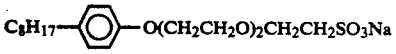 | 20 mg/m$^2$ |
| $C_8F_{17}SO_2N(C_3H_7)(CH_2CH_2O)_4(CH_2)_4SO_3Na$ | 2 mg/m$^2$ |
| $C_8H_{17}SO_2N(C_3H_7)(CH_2CH_2O)_{15}H$ | 5 mg/m$^2$ |
| Sodium polyacrylate (average molecular weight: 41,000) | 70 mg/m$^2$ |
| Proxel | 0.5 mg/m$^2$ |

1,2-Bis(sulfonylacetamido)ethane was used as a hardening agent in such an amount as to result in the degree of swelling shown in Table 2 (measured in the same manner as in Example 1). The thus obtained photographic materials were designated Samples 12 to 27.

4) Evaluation of Performance:

1) Sensitivity:

The sample was exposed to green light through a continuous wedge for 1/10 second and then subjected to rapid processing in a dry-to-dry time of 45 seconds in an automatic developing machine "Fuji X-ray Processor FPM-9000" manufactured by Fuji Photo Film Co., Ltd.

For development and fixing, the following non-hardening processing solutions were used. The reciprocal of the exposure amount which gave a density of fog +1.0 was determined and expressed relatively taking the result of Sample 12 as a standard (100).

| [Developing Solution] | |
|---|---|
| Potassium hydroxide | 24 g |
| Sodium sulfite | 40 g |
| Potassium sulfite | 50 g |
| Diethylenetriaminepentaacetic acid | 2.4 g |
| Boric acid | 10 g |
| Hydroquinone | 35 g |
| Diethylene glycol | 11.2 g |
| 4-Hydroxymethyl-4-methyl-1-phenyl-3-pyrazolidone | 2.5 g |
| 5-Methylbenzotriazole | 0.06 g |

-continued

| | |
|---|---|
| Water to make | 1 l |
| pH adjusted to 10.65 | |

Before development, the above composition was mixed with 10 ml of a starter containing 2 g of potassium bromide and 1.8 g of acetic acid, and the mixture was adjusted to pH 10.5.

| [Fixing Solution] | |
|---|---|
| Ammonium thiosulfate | 140 g |
| Sodium sulfite | 15 g |
| Disodium ethylenediaminetetraacetate dihydrate | 0.025 g |
| Sodium hydroxide | 6 g |
| Water to make | 1 l |
| pH adjusted with acetic acid to 4.8 | |

2) Pressure Resistance:

The sample was exposed to light of a tungsten lamp (2854° K., 100 lux) from both sides through a step wedge for 1/10 second. The surface of the sample before or after the exposure was scratched with a sapphire stylus (0.5R) under a load varying from 20 g to 200 g. The exposed sample was processed at 35° C. in an automatic developing machine "FPM-9000" using a developer "RD-7" and a fixer "Fuji F" both produced by Fuji Photo Film Co., Ltd. The degree of pressure sensitization and desensitization or pressure fog on the scratched part were observed and judged according to the following standard.

Good . . . No problem for practical use

Medium . . . Possibly problematical for practical use

Poor . . . Unacceptable for practical use

3) Screen Contamination:

Contamination of the screen was evaluated in the same manner as in Example 1.

4) Drying Properties:

One hundred cut films of the sample (25.4 cm×30.5 cm) were continuously processed in an atmosphere of 28° C. and 70% RH in the same manner as in (1) above, and drying properties were evaluated according to the following standard.

Good . . . No problem for practical use

Medium . . . Possibly problematical under some conditions of use

Poor .. Undried and unacceptable for practical use

5) Color Remaining:

The unexposed sample was subjected to rapid processing using an automatic developing machine "FPM-9000", a developer "RD-7" and a fixer "Fuji F" in a total processing time (dry-to-dry) of 45 seconds. The degree of color remaining was evaluated according to the following standard.

Good . . . No problem for practical use

Medium . . . Possibly problematical under some conditions of use

Poor . . . Undried and unacceptable for practical use

The results of the above evaluations are shown in Table 2 below.

TABLE 2

| Sample No. | Compound Added Kind | Compound Added Amount (mol/mol-Ag) | Single Spread of Binder (g/m$^2$) | Degree of Swelling (%) | Relative Sensitivity | Pressure Resistance | Screen Contamination | Drying Properties | Color Remaining | Remark |
|---|---|---|---|---|---|---|---|---|---|---|
| 12 | — | — | 5.0 | 220 | 100 | Good | Good | Poor | Good | Comparison |
| 13 | — | — | " | 180 | 90 | Good | Good | Medium | Poor | " |
| 14 | — | — | 3.0 | 220 | 115 | Poor | Good | Good | Good | " |

TABLE 2-continued

| Sample No. | Compound Added Kind | Compound Added Amount (mol/mol-Ag) | Single Spread of Binder ($g/m^2$) | Degree of Swelling (%) | Relative Sensitivity | Pressure Resistance | Screen Contamination | Drying Properties | Color Remaining | Remark |
|---|---|---|---|---|---|---|---|---|---|---|
| 15 | — | — | " | 180 | 110 | Poor | Good | Good | Good | " |
| 16 | Hydroquinone | $5 \times 10^{-2}$ | " | 220 | 115 | Good | Poor | Good | Good | " |
| 17 | Resorcin | " | " | " | 115 | Medium | Poor | Good | Good | " |
| 18 | I-2 | $1 \times 10^{-3}$ | " | " | 115 | Good | Good | Good | Good | Invention |
| 19 | " | " | " | 180 | 113 | Good | Good | Good | Good | " |
| 20 | I-9 | " | " | 220 | 113 | Good | Good | Good | Good | " |
| 21 | I-12 | " | " | " | 115 | Good | Good | Good | Good | " |
| 22 | I-21 | " | " | " | 113 | Good | Good | Good | Good | " |
| 23 | II-2 | $5 \times 10^{-2}$ | " | " | 116 | Good | Good | Good | Good | " |
| 24 | " | " | " | 180 | 115 | Good | Good | Good | Good | " |
| 25 | II-10 | " | " | 220 | 115 | Good | Good | Good | Good | " |
| 26 | II-11 | " | " | " | 113 | Good | Good | Good | Good | " |
| 27 | II-16 | " | " | " | 115 | Good | Good | Good | Good | " |

It can be seen from the results in Table 2 that the processing method according to the present invention (Samples 18 to 27) has excellent pressure resistance, cause no contamination of the screens, and exhibits rapid processing performance in sensitivity, drying, and color remaining properties.

EXAMPLE 3

Samples 28 to 39 were prepared in the same manner as in Example 1, except that the time of addition of the compound of formula (I) or the comparative compound was changed as shown in Table 3 below and that 10.9 g of sodium 2,5-dihydroxybenzenesulfonate was further added to the emulsion. Further, the emulsion layer coating composition was dissolved at 40° C. for a time period shown in Table 3 and then coated simultaneously with the surface protective layer coating composition by co-extrusion.

The resulting samples were evaluated in the same manner as in Example 1. The sensitivity was relatively expressed taking that of Sample 28 as a standard (100). The results of evaluations are shown in Table 3.

TABLE 3

| Sample No. | Compound (I) Time of Addition | Compound (I) Kind | Compound (I) Amount ($mg/m^2$) | Time of Emulsion Dissolution (40° C.) | Relative Sensitivity | Pressure Resistance | Contamination of Screen | Remark |
|---|---|---|---|---|---|---|---|---|
| 28 | — | — | — | 30 min. | 100 | Poor | Good | Comparison |
| 29 | — | — | — | 6 hrs. | 100 | Poor | Good | " |
| 30 | At the preparation of coating composition | Hydroquinone | 100 | 30 min. | 100 | Good | Poor | " |
| 31 | At the preparation of coating composition | " | " | 6 hrs. | 80 | Good | Poor | " |
| 32 | At the preparation of coating composition | I-3 | 5 | 30 min. | 100 | Good | Good | Reference |
| 33 | At the preparation of coating composition | " | " | 6 hrs. | 45 | Good | Good | " |
| 34 | Before chemical sensitization* | " | " | 30 min. | 100 | Good | Good | Invention |
| 35 | Before chemical sensitization* | " | " | 6 hrs. | 100 | Good | Good | " |
| 36 | At the preparation of coating composition | I-9 | " | 30 min. | 100 | Good | Good | Reference |
| 37 | At the preparation of coating composition | " | " | 6 hrs. | 35 | Good | Good | " |
| 38 | Before chemical sensitiztion | " | " | 30 min. | 100 | Good | Good | Invention |
| 39 | Before chemical sensitiztion | " | " | 6 hrs. | 100 | Good | Good | " |

Note: *The compound was added together with thiourea dioxide, and the amount of chloroauric acid was adjusted.

As is apparent from Table 3, the samples according to the present invention have excellent pressure characteristics and cause no contamination of the screens. In addition, the sensitivity of these samples is not affected even if the emulsion coating composition is dissolved.

While the invention has been described in detail and with reference to specific examples thereof, it will be apparent to one skilled in the art that various changes and modifications can be made therein without departing from the spirit and scope thereof.

What is claimed is:

1. A method for processing an imagewise exposed silver halide photographic material comprising the step of subjecting said imagewise exposed silver halide photographic material to a developer, wherein said imagewise exposed silver halide photographic material comprises a support having on one side thereof at least one light-sensitive silver halide emulsion layer, the total amount of binder on the side of said support having thereon said at least one light-sensitive silver halide emulsion layer being not more than 3.0 g/m$^2$, said image wise exposed silver halide photographic material further comprising at least one layer containing at least one compound selected form the group consisting of compounds (a), (b) or (c):

(a) a compound represented by formula (I):

$$X_1-A-X_2$$

wherein $X_1$ and $X_2$ each represents

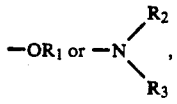

wherein $R_1$ represents a hydrogen atom or a group capable of being converted to a hydrogen atom on hydrolysis, and $R_2$ and $R_3$, which may be the same or different, each represents a hydrogen atom, an alkyl group, an aryl group, a heterocyclic group, an alkylsulfonyl group, an arylsulfonyl group, a heterocyclic sulfonyl group, an alkylcarbonyl group, an arylcarbonyl group, a heterocyclic carbonyl group, a sulfamoyl group, or a carbamoyl group; and A represents an arylene group; provided that at least one of $X_1$, $X_2$, and A has a hydrogen atom thereof substituted with a group which accelerates adsorption onto silver halide grains;

(b) a compound represented by formula (II):

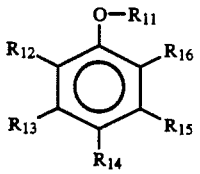

(II)

wherein $R_{11}$ represents a hydrogen atom, $R_{12}$ represents a hydroxyl group or a sulfonamido group, $R_{13}$ represents a hydrogen atom or a substituent, $R_{14}$ represents a carbamoyl group, an oxycarbonyl group, an acyl group, or a sulfonyl group, $R_{15}$ represents a hydrogen atom or a substituent, $R_{16}$ represents a hydroxyl group or a sulfonamido group, the total number of carbon atoms contained in $R_{12}$, $R_{13}$, $R_{14}$, $R_{15}$ and $R_{16}$ is at least 6, and any two of $R_{12}$, $R_{13}$, $R_{14}$, $R_{15}$, $R_{16}$ and $OR_{11}$ may together form a ring; and (c) a polymer compound formed by two or more of said compounds of formula (II) bonding to each other at any unsubstituted position of the benzene ring in formula (II);

wherein said processing is effected in a total processing time of from 15 to 45 seconds.

2. The method as claimed in claim 1, wherein said at least one compound is a compound of formula (I) represented by formula (III):

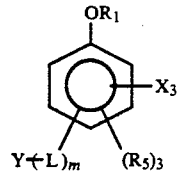

(III)

wherein Y represents an adsorption accelerating group; L represents a divalent linking group; m represents 0 or 1; $X_3$ has the same meaning as $X_1$ or $X_2$ in formula (I); and the $R_5$ groups, which may be the same or different, each represent a hydrogen atom or a substituent.

3. The method as claimed in claim 2, wherein $X_3$ is an —OH group.

4. The method as claimed in claim 2, wherein $X_3$ is an

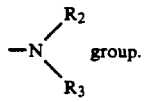

group.

5. The method as claimed in claim 1, wherein said at least one compound is a compound of formula (II) and the total number of carbon atoms contained in $R_{12}$, $R_{13}$, $R_{14}$, $R_{15}$, and $R_{16}$ is at least 8.

6. The method as claimed in claim 1, wherein the at least one layer containing said at least one compound is a light-sensitive silver halide emulsion layer.

7. The method as claimed in claim 6, wherein said at least one layer contains $1\times10^{-5}$ to $1\times10^{-1}$ mole, per mol of silver halide, of the compound of formula (I).

8. The method as claimed in claim 6, wherein said at least one layer contain contains $1\times10^{-4}$ to 1 mol, per mol of silver halide, of the compound of formula (II).

9. The method as claimed in claim 1, wherein the group accelerates adsorption onto silver halide grains is represented by formula $Y\text{-}(L)_m$, wherein Y is selected from the group consisting of a thioamido group, a mercapto group, a group containing a disulfide linkage and a 5- or 6-membered nitrogen-containing heterocyclic group, L represents a divalent linking group selected from the group consisting of an alkylene group, an alkenylene group, an alkynylene group, an arylene group, —O—, —S—, —NH—, —N=, —CO— and —$SO_2$—, alone or in combination, and wherein m represents an integer of 0 or 1.

10. The method as claimed in claim 1, wherein the substituent represented by $R_{13}$ and $R_{15}$ is selected from the group consisting of a halogen atom, a hydroxyl group, a sulfo group, a carboxyl group, a cyano group, a straight chain, branched, or cyclic alkyl group having not more than 30 carbon atoms, an alkenyl group, an alkynyl group, an aralkyl group, an aryl group, an alkoxy group, an aryloxy group, an alkylthio group, an arylthio group, a carbonamido group, a sulfonamido group, a ureido group, an alkoxycarbonylamino group, an aryloxycarbonylamino group, an acyloxy group, a sulfamoylamino group, a sulfonyloxy group, a carbamoyl group, a sulfamoyl group, an acyl group, a sulfonyl group, an alkoxycarbonyl group, an aryloxycarbonyl group, or a 3- to 12-membered herterocyclic group containing at least one hetero atom selected from the group consisting of oxygen, nitrogen, sulfur, phosphorus, selenium, and tellurium.

11. The method as claimed in claim 1, wherein said polymer compound is a dimer formed by two of said compounds of formula (II).

12. The method as claimed in claim 1, wherein said polymer compound comprises from 20 to 50 repeating units, said repeating units being said compounds of formula (II).

* * * * *